US005735526A

United States Patent [19]

Mastandrea

[11] Patent Number: 5,735,526

[45] Date of Patent: Apr. 7, 1998

[54] METHOD FOR EVALUATION OF SHOTGUN ROUND AND TARGET

[76] Inventor: Frank Mastandrea, 1300 Hamilton Rd., Pittsburgh, Pa. 15234

[21] Appl. No.: 831,500

[22] Filed: Mar. 31, 1997

[51] Int. Cl.[6] ..... F41J 5/16

[52] U.S. Cl. ..... 273/378; 273/409

[58] Field of Search ..... 273/403, 404, 273/407, 408, 409, 378

[56] References Cited

U.S. PATENT DOCUMENTS

| | | | |
|---|---|---|---|
| D. 262,819 | 1/1982 | Dulude | D22/15 |
| 4,203,600 | 5/1980 | Brown | 273/407 |
| 5,118,116 | 6/1992 | Cherni | 273/408 |
| 5,181,719 | 1/1993 | Cleveland, III | 273/409 |
| 5,275,890 | 1/1994 | Wolf et al. | 428/514 |
| 5,415,415 | 5/1995 | Mujic | 273/409 |
| 5,558,337 | 9/1996 | Frank, III | 273/408 |

*Primary Examiner*—Mark S. Graham
*Attorney, Agent, or Firm*—Kenneth P. McKay, Esq.

[57] ABSTRACT

A method for the evaluation of the pattern of shot resulting from a single shotgun round for purposes of optimizing the selection of ammunition type and prediction of shot pattern, and a target for its implementation. The shooter fires a single round at the target. Then a rotating overlay allows the pattern of shot to be evaluated with respect to a center aim point and an overlay axis and kill zone. The overlay is rotated through a series of clockwise, then counterclockwise increments. At each increment, the target is scored with respect to the overlay. The number of shot striking the kill zone for each position of the overlay axis is computed and by observation the shooter can determine the optimal ammunition for use with the weapon and for a given type of game.

2 Claims, 7 Drawing Sheets

METHOD FOR EVALUATION OF SHOTGUN ROUND AND TARGET

BACKGROUND OF THE INVENTION

1. Field of the Invention

The invention is a method, and a target for its employment, for the evaluation of the pattern of shot resulting from a single shotgun round for purposes of optimizing the selection of ammunition type and prediction of shot pattern.

As the type and manufacturer of shotgun rounds are varied for a given shotgun, and shooting at the same target, the shooter will observe a corresponding variation in the pattern of the shot among the varying rounds. For the shooter who requires an exacting knowledge of the resulting shot pattern, it is important to know the relative location of the striking pattern and the density of striking shot with respect to the aim point. This is most especially true on an axially-oriented target such as the neck of game birds or small game which are moving rapidly (stretched out). In fact, the profile of a game animal in the wild, in real game hunting situations, is ever-changing.

2. Description of the Related Art

The prior art shows targets which are a variety of sizes and shapes. All are intended to allow the sighting of weapons. Few are related specifically to shotgun sighting. One such target, which is commonly seen in use, is the circular target showing a game bird with its neck aligned on the vertical axis (six o'clock position to the twelve o'clock position). In using such a target, the shooter fires a round using the aim point of the target center. He or she then inspects the target to see, relative to the vertical axis and the target center, where the shot pattern is most centrally focused, and then adjusts the aiming point. For instance, if the shooter's inspection shows that there were 18 shot which impacted the target and the center of the mass of all 18 shot was two inches from center, on the axis running from the eight o'clock position to the two o'clock position, the shooter would thereafter adjust the aiming point two inches from center on the opposite axis (i.e., running from the two o'clock position toward the eight o'clock position). However, this does not accommodate the field conditions of the game being hunted, where the linear target may be aligned in a radial direction other than vertical. This is, in fact, the usual case, and the particular shooter is concerned about the resulting deviation.

The prior art also shows some means of determining compensation of rounds, but many such sighting mechanisms are complex and expensive. None are easily determinative of the relative center of mass of shot such as allowed for by the present invention.

PRIOR ART

U.S. Pat. No. 5,275,890 (Wolf et al), discloses a target which is comprised of two substantially planar sheets. The front target sheet carries the target at which the weapon is aimed. The color of the front surface of the second sheet contrasts with the color of the first sheet thereby allowing the user to perceive the results of each shot instantaneously. This feature facilitates the user adjusting his or her shot instantaneously without first having to view the target up close.

U.S. Pat. No. 4,203,600 (Brown) shows a target comprised of a freestanding "life-size" model of a deer that serves as the general target. Into a slot in the animal is placed a paper target sheet which is representative of the internal organs of the animal and thus the desired "kill zones." This removable sheet serves as the actual disposable target used for shot pattern results and score recordings.

U.S. Pat. No. D262,819 (Dulude) shows a commonly available type of commercial target with a center aiming point and a pattern for locating the strike of ammunition relative to this aiming point.

There are a variety of commercial targets which also serve as prior art, including target which are circular and have scoring grids imposed thereon.

SUMMARY OF THE INVENTION

The objective of the present invention is to provide a more exact means of analyzing the spread of shot which strikes a target, relative to an aim point and an axis, and accounting for the fact that an actual game animal, as a target and while being hunted, has an ever-changing profile. It is intended for use with shotguns.

This method and the respective target is particularly useful when selecting ammunition based on the type of game to be hunted and the proximity of the game, wherein the shooter may best predict the shape of a shot pattern with respect to an aiming point and a target profile.

This is accomplished by use of an overlay to the target, which rotates incrementally around the target along a series of axes, thereby providing a relative means of assessing the strike, based on a single round into the target, as follows.

The Method for Evaluation of Shotgun Round and Target comprises the use of a circular target surface, sub-divided into a multitude of axially divided (wedge-shaped) segments. The center circular area of the target, focused around the center aiming point, contains a game animal in frontal profile, designated a "kill zone". The kill zone is subdivided into circular divisions for enumeration of the shot. The number of segments used varies on the accuracy of evaluation desired by the shooter.

In the Method, a single shot is directed to the target at a center aim point.

An observation of the target is then made. With respect to the vertical axis through the center, the number of shot striking the frontal profile is recorded by the shooter in the scoring area at the end of the center axis at the 12 o'clock position. An overlay then is used to determine the relative location of the shot pattern with respect to the varying inclination of the selected game animal kill zone. The overlay is a side profile of the same selected game animal and is meant to represent that animal in a different perspective. The overlay is transparent such that the shot pattern may be observed through the overlay. The rotating overlay has a similarly defined "overlay kill zone" but having a different area comprised therein.

The overlay is superimposed over succeeding axis alignments (i.e., the seven o'clock to one o'clock position, then the eight o'clock to two o'clock position). The shooter determines, on the basis of the rotated axis, the number of shots striking the overlay zone, and records that score. An area for recording is provided at the outer peripherary of the target. The overlay axis is incrementally rotated clockwise onto each axis. Upon completion of the clockwise rotation, the overlay is reversed for succeeding super-positioning over the counterclockwise segments. The overlay is rotated counterclockwise, starting at the five o'clock to eleven o'clock axis, succeedingly through all of the left side axis, recording the shot strike accordingly. It is important to note that the scores are recorded for the same shotgun round, only with respect to varying perspectives through the overlay axis, as it is rotated.

In the preferred embodiment of the present invention, this is accomplished by the addition of all shot striking the kill zone in each increment and with respect to the game profile resulting from the respective superposition of the overlay. For instance, if the target game of concern is a turkey, the shooter superimposes an overlay having as its longitudinal axis a figure comprising the kill zone of a turkey (head, neck, upper breast) and determines how many shot would have impacted the game animal in the kill zone had the target been the game animal in the position indicated by the overlay in its respective relative position. As the axis is rotated, the number of shots in each rotating kill zone is recorded. At the completion of the evaluation, the shooter can readily observe which kill zone contains the highest number of shot.

The shooter observes that, if there is a cluster of axes where the relative number of strikes in the kill zone becomes apparently the most advantageous, the shooter can conclude that this ammunition is most effective for the game animal represented by the target, in the above example, a turkey. That conclusion assures the shooter that, regardless of the orientation of the game animal "kill zone", with respect to any center aiming point, his opportunity for a fatal strike upon the animal is the greatest.

The invention, in its preferred embodiment, comprises the use of a target with twelve axial segments and an overlay used to count the shot on a rotating basis. This forms thirteen axes propagating as radii from the center of the target, thereby allowing as many as thirteen evaluations. The number of shots is recorded in a figure located at the outer boundary of each of the respective thirteen vertical axes of the circular target. These thirteen individual target areas may also be used for other weapon sighting adjustment, for instance, an adjustment of a rifle which can be fired many times, respectively at each of the thirteen individual targets.

For ease of use, complete instructions may be printed on the target and overlay, explaining the system for the shooter. Also included is a conventional scoring chart for recording the conventional circular shot pattern adjustment as a permanent record for a given weapon, using a given type and maker of ammunition.

DETAILED DESCRIPTION OF THE PREFERRED EMBODIMENT

Figure 1:
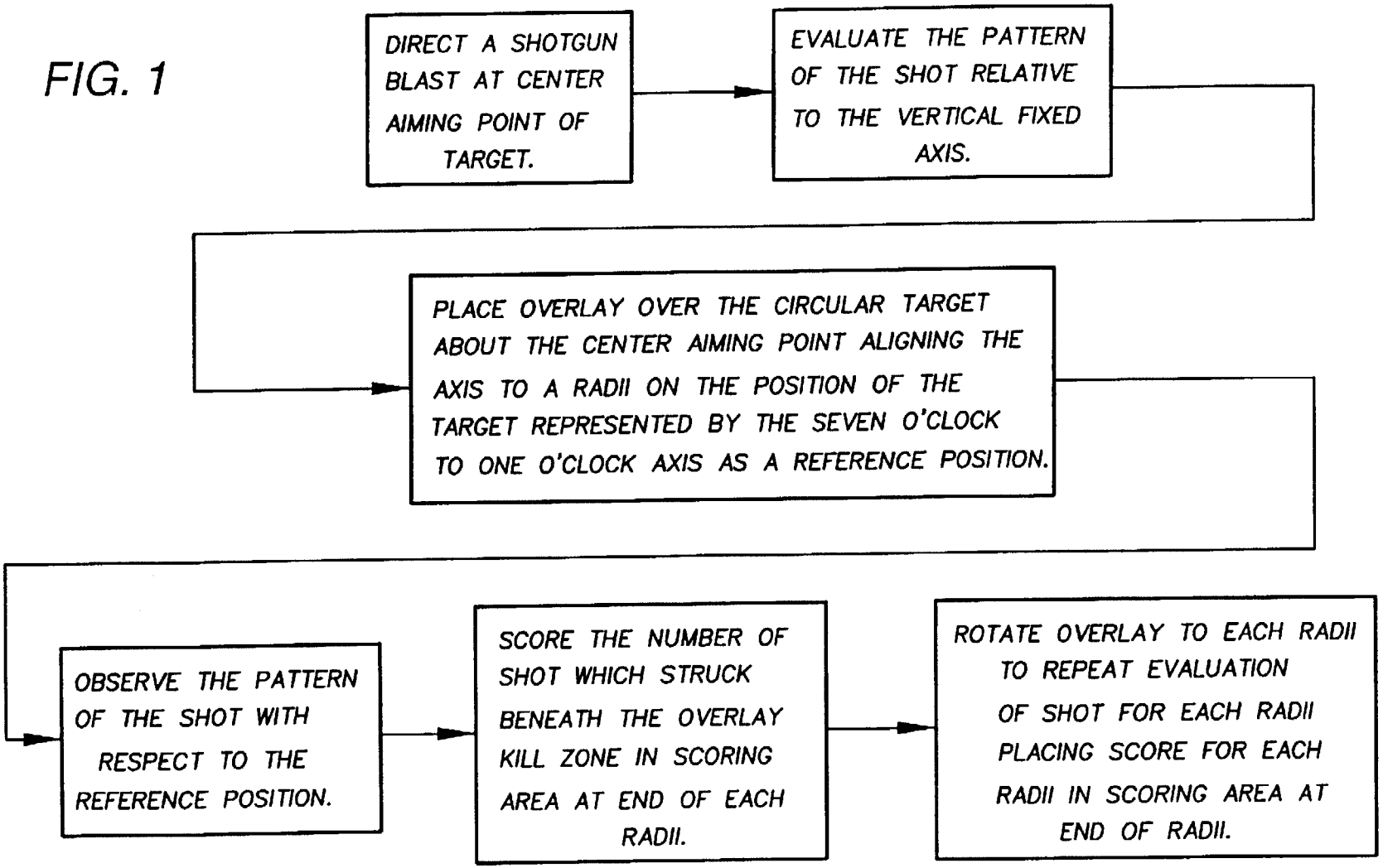
FIG. 1 is a block diagram showing the Method for Evaluation of Shotgun Round and Target showing the principal steps for use in the Method.

FIG. 1 shows the subject invention in a step form for ease and clarity of understanding which will be referred to herein as the system is explained.

Figure 2:
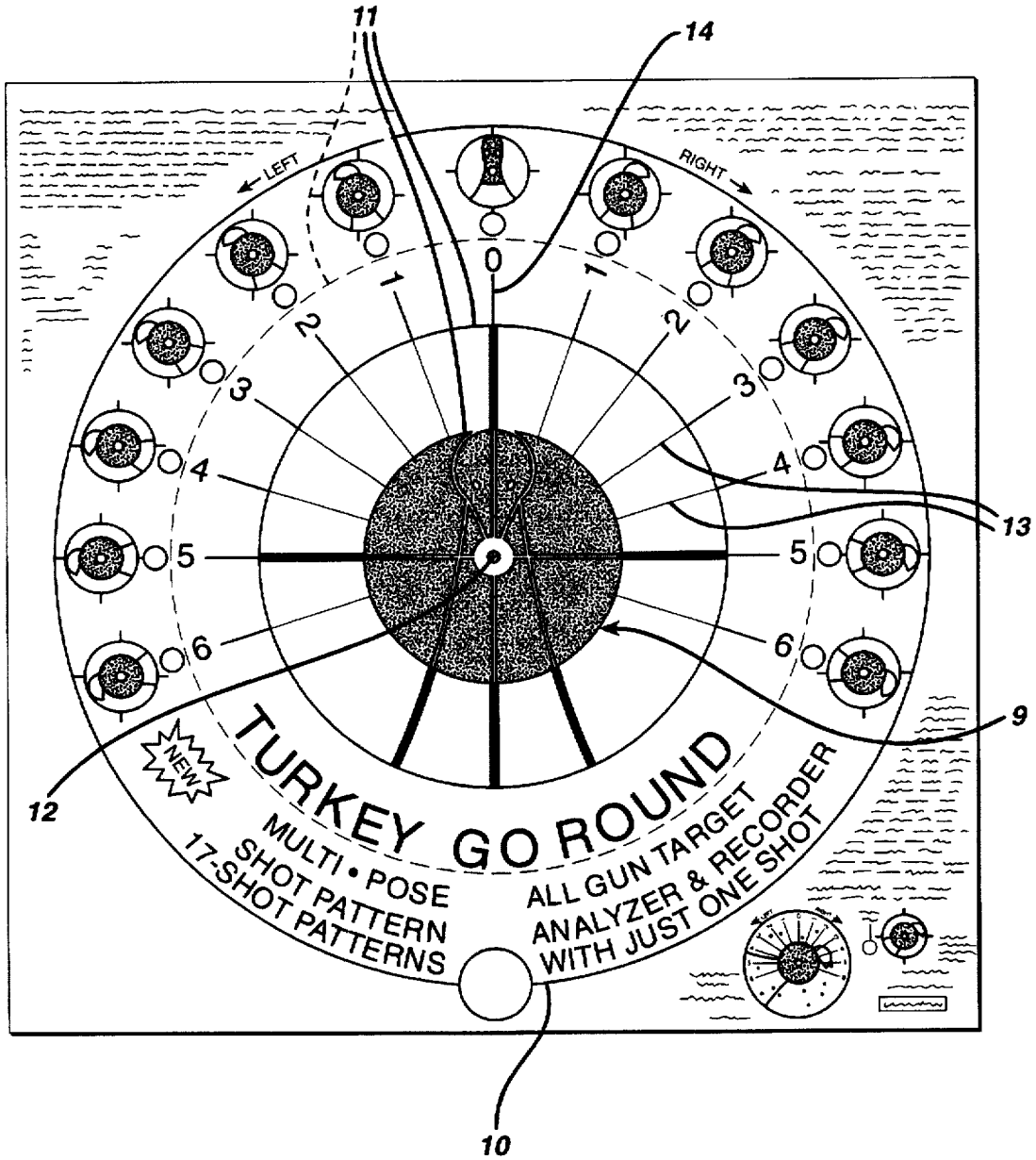
FIG. 2 is a view of the target used in the Method for Evaluation of Shotgun Round and Target showing the target in its complete assembly.

FIG. 2 shows a target for use in the Method. The sighting target is a form whereby a large circle 10 encompasses a multitude of smaller circles 11 all originating from the same center aim point 12. Propagating from the center aim point 12 are a multitude of radii 13, equally spaced circumferentially around the target from the center vertical axis 14. A multitude of smaller circles 11 are encompassed within the larger circle and spaced from each other such that relative radial distance from the center may be determined.

The shooter takes careful aim at the center aim point 12 and fires a single round at the target. The object of the shot is to direct the round at the center aim point 12 which is the exact geometric center of the target. The center vertical axis 14 runs from the six o'clock to the twelve o'clock position. The shooter evaluates the target with respect to the strike of the shot relative to the center vertical axis 14. Contained at the center of target, circumscribing the center aim point 12 is a kill zone 9 which portrays the vital portion of a game animal in frontal view.

Figure 3:
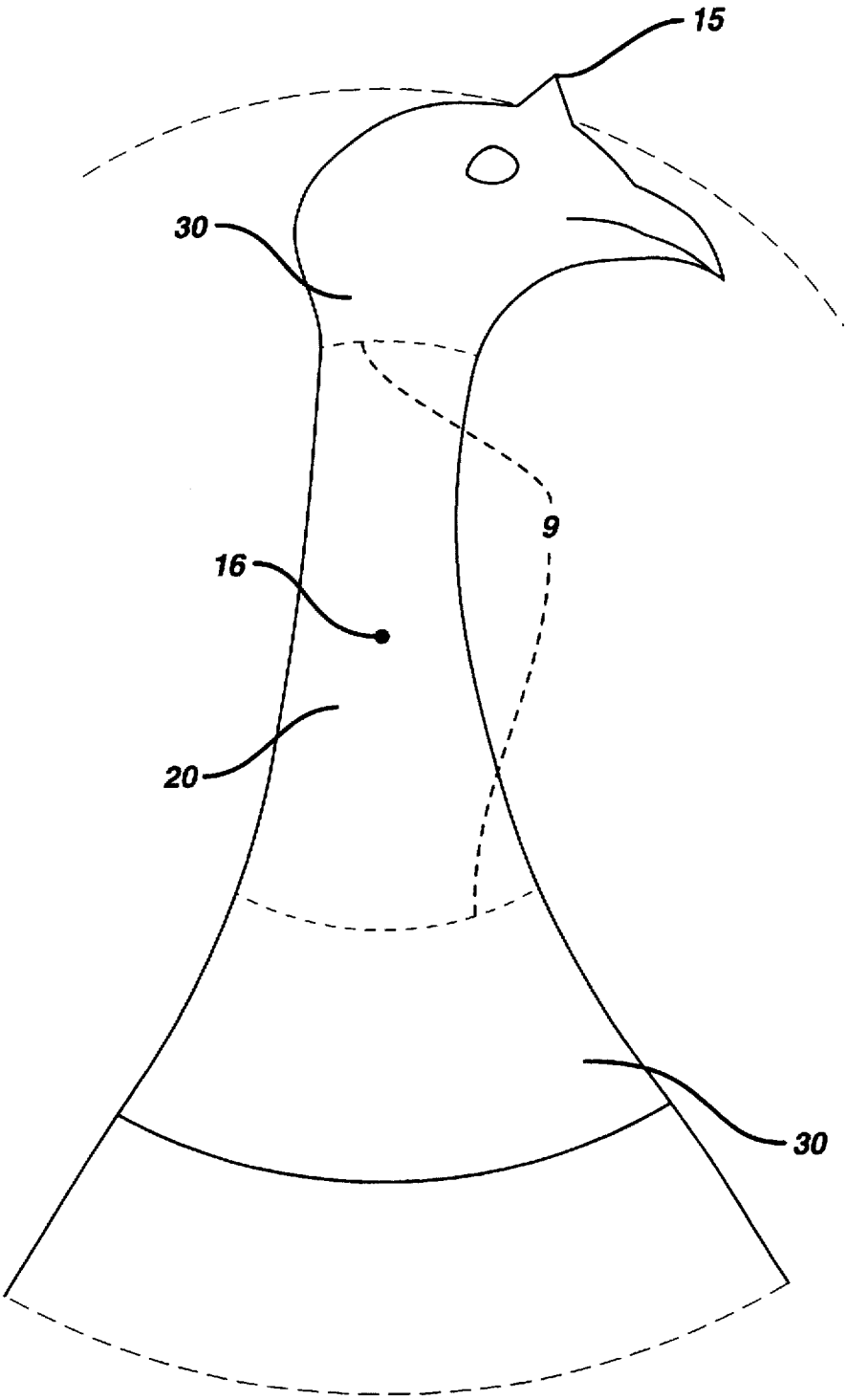
FIG. 3 is a view of the overlay used to rotatably determine the relative shot pattern around each segment of the target.

FIG. 3 shows the overlay 20 used to rotatably determine each segment center axis in an embodiment which has an overlay pointer 15 at the end and having with a radial length less than the radius of the large circle 10. It is transparent and having an overlay kill zone 30 similarly configured to, but larger than, the kill zone 9 except portraying the game animal in profile.

At overlay point 16, the overlay may be aligned with the center aim point 12. Overlay pointer 15 may be rotatably aligned thereby aligning with any of multitude of radii 13.

Figure 4:
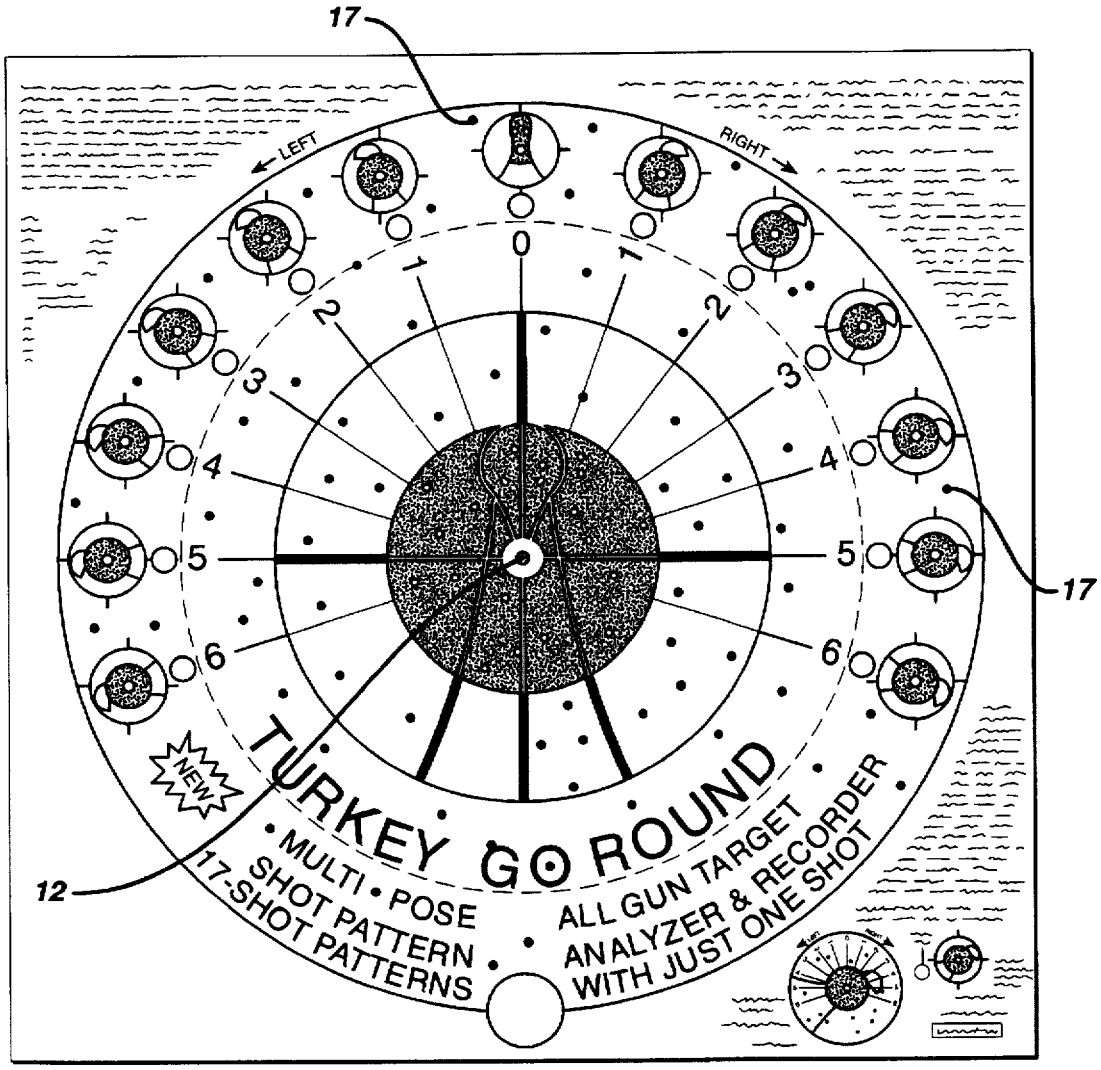
FIG. 4 is a view of the target without an overlay, a shot having been fired at an aiming point in the center, meant to be demonstrative of game with a linear target in the upright and frontal position.

FIG. 4 demonstrates the target after a single shotgun round was discharged at its center aim point 12 allowing a multitude of shot 17 to impact the target.

Figure 5:
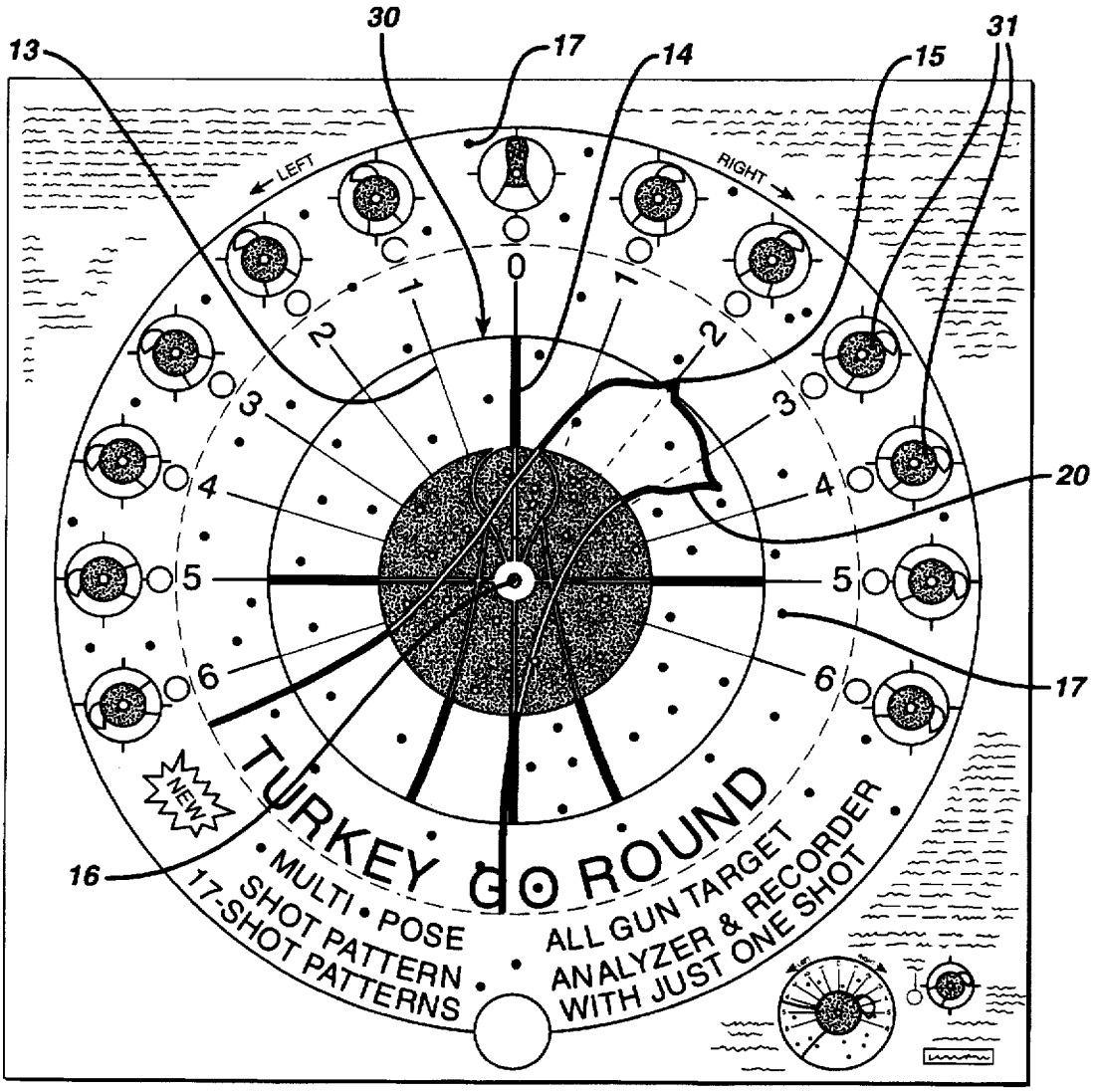
FIG. 5 shows a view of the target, with the same shot pattern, but with an overlay in the eight o'clock to two o'clock axis, showing a pattern of shot around that axis. It can be observed that the relative spread of shot is different for the evaluation with respect to the overlay as compared to the evaluation for the target about the vertical axis.

FIG. 5 shows the same shot pattern comprised of a multitude of shot 17 having overlay 20 superimposed along a radii from the eight o'clock to two o'clock direction. The shooter then observes the target using the overlay 20 as follows. First the overlay 20 is positioned over the next of the segments formed between adjoining multitude of radii 13 and the center vertical axis 14. This is accomplished by aligning overlay pointer 15 over a multitude of radii 13 as a selected axis. The overlay point 16 is aligned over center aim point 12. The spread of the shot is evaluated at this observation point by evaluating where the largest number of shot have struck the target. The evaluation consists of scoring the number of shot which has struck beneath the overlay kill zone 30. At the end of each multitude of radii 13 on the outer periphery of the target is a scoring area 31, used for the recording of the score with respect to each axis of rotation, reflecting a smaller, but relatively proportioned overlay kill zone.

The observation is then repeated for every radii as the overlay is rotated, first clockwise from the seven o'clock to one o'clock position forward through the last of the clockwise segments comprised of the areas between adjoining radii 13.

The observation for the counterclockwise segments is then conducted, first by reversing the profile of the overlay 20, first at the eleven o'clock to five o'clock position and then scoring counterclockwise around the target as was accomplished for the clockwise segments.

The multitude of shot 17 shows a different configuration when comparing the pattern about the center vertical axis 14 as relative to the pattern when observed through the overlay 20. From subsequent rotations of overlay 20, along different radii 13, the user may determine the optimal type of ammunition for a given weapon, at a known distance and for a chosen target figure or game. In the preferred embodiment, this is accomplished by summing the number of shot impacting the kill zone 30 for each axial alignment. At the end of the assessment, the number of shots impacting each kill zone 30 may be assessed to determine the most appropriate ammunition for use with the weapon.

Figure 6:
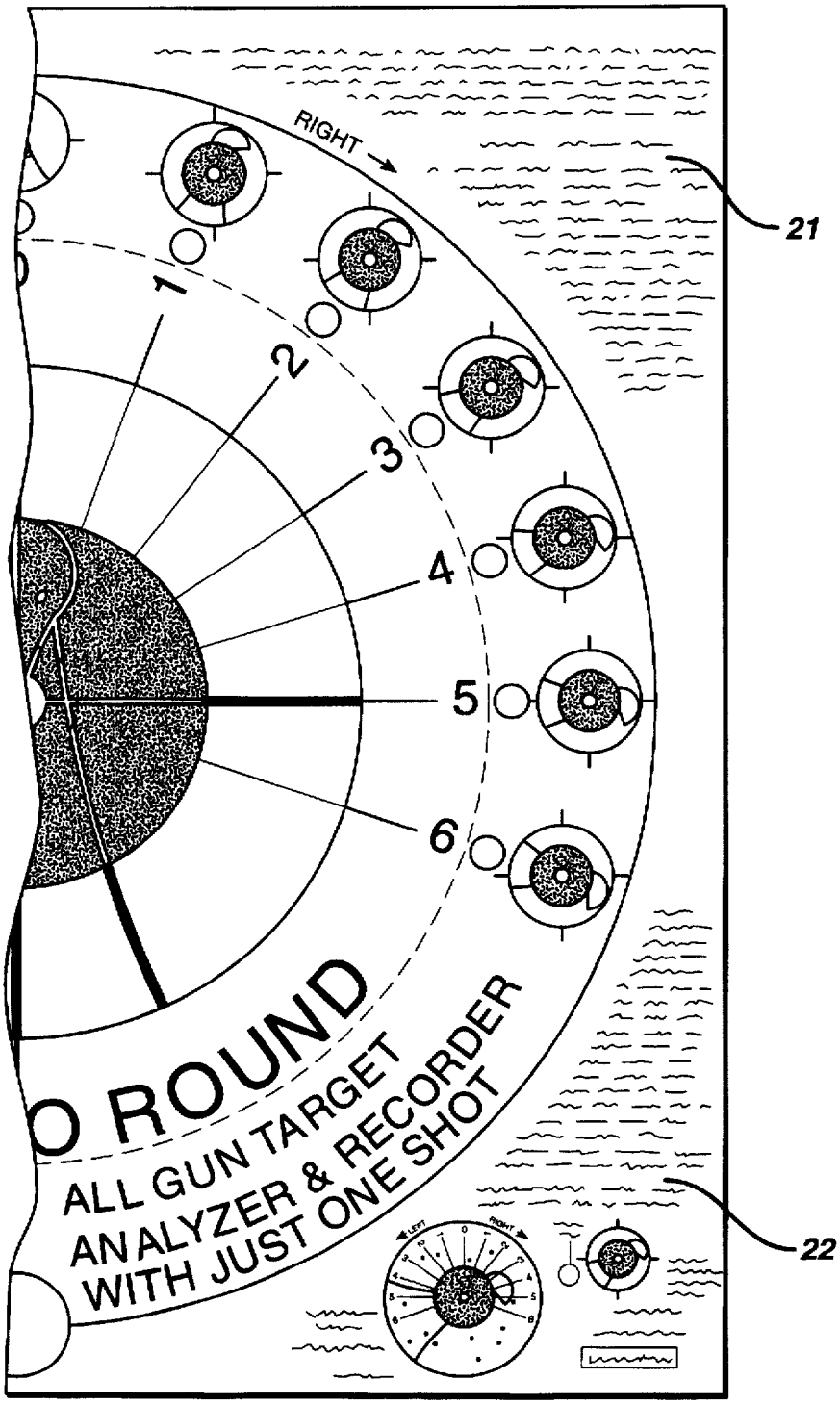
FIG. 6 shows a preferred embodiment of a target whereby instructions are given the shooter in the upper right and lower right target quadrants.

FIG. 6 shows the preferred embodiment whereby instructions are given the shooter in the upper right target quadrant 21 and lower right target quadrant 22 for the use of the target and easy reference.

Figure 7:
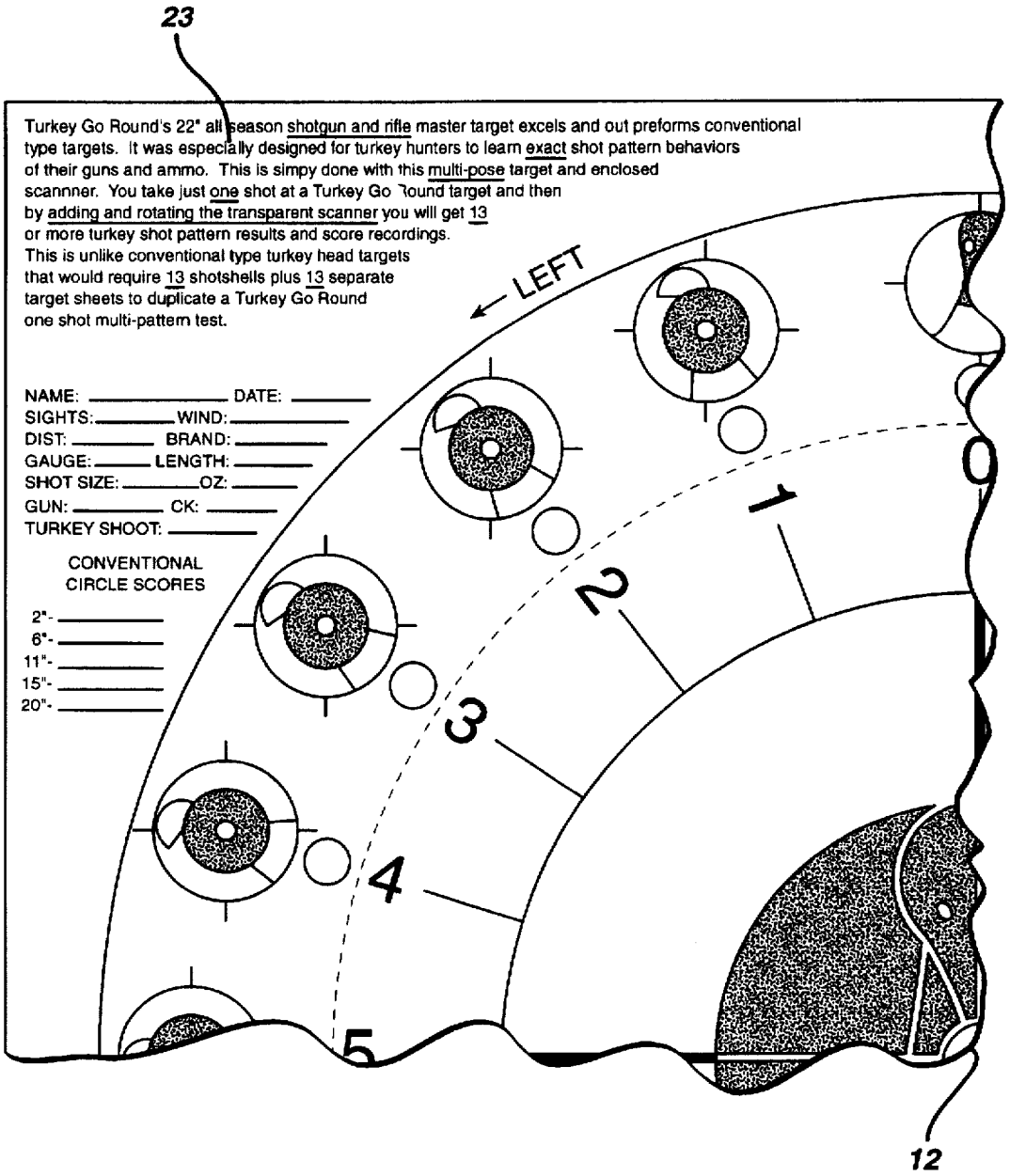
FIG. 7 shows the preferred embodiment of a target whereby instructions and conventional scoring records are given in the upper left quadrant.

FIG. 7 shows the preferred embodiment whereby additional instructions and a conventional scoring record is given in the upper left target quadrant 23. This allows the user to maintain a permanent record of his scoring for a conventional, single shot at the center aim point 12.

What is claimed is:

1. A target for use in evaluating the shot spread and pattern for a shotgun, to optimize the selection of ammunition, comprising:

a. a rectangular target background;

b. a circle circumscribed within said rectangular target background, said circle having a center aiming point, a periphery, and a diagonal line as a fixed vertical axis;

c. a multitude of regularly spaced radii propagating from said center aiming point outward to and intersecting with said circle periphery;

d. a multitude of scoring areas, in a number corresponding to the multitude of regularly spaced radii, each of said scoring areas being located outside and adjacent to said periphery at a respective point of intersection of said radii with said periphery;

e. a multitude of concentric, smaller circles within said circle and focused about said center aiming point each having a small circle periphery whereby the relative distance of said smaller circle periphery from said center aiming point is usable for measuring;

f. a game animal picture in frontal view imposed upon said center aiming point and having a kill zone comprising the game animal head area, game animal neck area and game animal breast area;

g. a transparent overlay having a center of rotation and which is superimposable over and rotatable about said center aiming point and having an overlay pointer at its outermost point whereby an imaginary axis extends through said center of rotation and said overlay pointer, said imaginary axis corresponding to said fixed vertical axis in length, and having a profile view of said game animal inscribed about said imaginary axis, said profile view having an overlay kill zone comprising the profile game animal head area, profile game animal neck area and profile game animal breast area; and, h. written instructions for the employment of said target printed in between said periphery and said rectangular background.

2. A method for evaluating the shot spread and pattern of a shotgun, to optimize the selection of ammunition, employing the target claimed in claim 1, comprising the steps of:

a. directing a shotgun blast at said center aiming point whereby a pattern of shot is imposed upon said target;

b. evaluating said pattern of shot whereby the number of shot striking the target within said kill zone is observed and recorded;

c. placing said transparent overlay over said circle about said center aiming point;

d. superimposing said imaginary axis over the radii of said target which is one increment in the clockwise direction removed from said vertical axis;

e. observing said pattern of shot with respect to said overlay kill zone whereby the number of shot striking the target beneath the overlay kill zone is observed and recorded;

f. rotating said imaginary axis clockwise one increment marked by said equally-spaced radii;

g. observing again said pattern of shot with respect to respect to said overlay kill zone whereby the number of shot striking the target beneath the overlay kill zone is observed and recorded;

h. repeating said observing of said pattern of shot for each clockwise increment marked by said equally-spaced radii;

i. reversing said overlay;

j. superimposing said imaginary axis over the radii of said target which is one increment in the counter clockwise direction removed from said vertical axis;

k. observing again said pattern of shot with respect to said reference position whereby the number of shot striking the target beneath the overlay kill zone is observed and recorded;

l. rotating said reference position counter-clockwise one increment marked by said equally-spaced radii;

m. observing again said pattern of shot with respect to said reference position whereby the number of shot striking the target beneath the overlay kill zone is observed and recorded;

n. repeating said observing of said pattern of shot for each counter clockwise increment marked by said equally-spaced radii;

o. observing the optimum axis for said pattern of shot by evaluating each of said observations whereby the reference position having the highest number of shot striking said target beneath said overlay kill zone with respect to said reference position is identified and recorded; and, p. adjusting the selection of ammunition accordingly.

* * * * *